US006908263B1

(12) United States Patent
Ruel et al.

(10) Patent No.: US 6,908,263 B1
(45) **Date of Patent: *Jun. 21, 2005**

(54) MECHANICALLY STABILIZED EARTH WALL SYSTEMS AND METHODS

(75) Inventors: Steve Ruel, San Jose, CA (US); David Swanson, San Jose, CA (US)

(73) Assignee: SSL, LLC, Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/746,608

(22) Filed: Dec. 23, 2003

Related U.S. Application Data

(63) Continuation of application No. 10/213,739, filed on Aug. 6, 2002, now Pat. No. 6,685,400.
(60) Provisional application No. 60/310,559, filed on Aug. 6, 2001.

(51) Int. Cl.[7] ..... E02D 17/00
(52) U.S. Cl. ..... 405/284; 405/262
(58) Field of Search ..... 405/284, 262, 405/285, 286, 287; 52/604

(56) References Cited

U.S. PATENT DOCUMENTS

| | | | | | |
|---|---|---|---|---|---|
| 3,631,682 | A | | 1/1972 | Hilfiker et al. | |
| 3,922,864 | A | | 12/1975 | Hilfiker | |
| 4,117,686 | A | | 10/1978 | Hilfiker | |
| 4,266,890 | A | | 5/1981 | Hilfiker | |
| 4,384,810 | A | * | 5/1983 | Neumann | 405/284 |
| 4,391,557 | A | | 7/1983 | Hilfiker et al. | |
| 4,505,621 | A | | 3/1985 | Hilfiker et al. | |
| 4,856,939 | A | | 8/1989 | Hilfiker | |
| 4,968,186 | A | * | 11/1990 | Ogorchock | 405/262 |
| 5,017,050 | A | | 5/1991 | Jaecklin | |
| 5,076,735 | A | | 12/1991 | Hilfiker | |
| 5,163,261 | A | * | 11/1992 | O'Neill | 405/284 |
| 5,224,801 | A | * | 7/1993 | Quaney | 405/273 |
| 5,484,235 | A | | 1/1996 | Hilfiker et al. | |
| 5,494,379 | A | | 2/1996 | Anderson et al. | |
| 5,531,547 | A | | 7/1996 | Shimada | |
| 5,564,865 | A | * | 10/1996 | Jansson | 405/286 |
| 5,622,455 | A | | 4/1997 | Anderson et al. | |
| 5,647,695 | A | | 7/1997 | Hilfiker et al. | |
| 5,722,799 | A | | 3/1998 | Hilfiker | |
| 5,820,305 | A | * | 10/1998 | Taylor et al. | 405/286 |
| 6,036,405 | A | * | 3/2000 | Nove et al. | 405/284 |
| 6,086,288 | A | * | 7/2000 | Ruel et al. | 405/262 |
| 6,113,317 | A | | 9/2000 | Myers | |
| 6,402,435 | B1 | | 6/2002 | Lewis | |
| 6,685,400 | B1 | * | 2/2004 | Ruel et al. | 405/284 |

FOREIGN PATENT DOCUMENTS

| | | | | |
|---|---|---|---|---|
| GB | 2059484 A | | 4/1981 | |
| GB | 2216933 A | * | 10/1989 | E02D/17/20 |
| JP | 0051424 | | 3/1991 | |
| JP | 05033346 A | | 2/1993 | |

* cited by examiner

*Primary Examiner*—Heather Shackelford
*Assistant Examiner*—Lisa Saldano
(74) *Attorney, Agent, or Firm*—Michael R. Schacht; Schacht Law Office, Inc.

(57) ABSTRACT

A retaining wall system for stabilizing an earthen wall comprising a plurality of face panels, a plurality of anchor mesh panels, and a plurality of connecting pins. The face panels each comprise first and second connecting portions and a wall portion. Each connecting portion comprises an upper surface and a bottom surface and defines a void system. The wall portion defines a face surface and a retaining surface. The face panels are stacked in a plurality of vertically spaced rows. The first vertically spaced row is arranged above the second vertically spaced row. A wall face is defined by the face surfaces of the wall portions and openings formed between vertically spaced wall portions and between horizontally spaced connecting portions. A portion of the anchor mesh panels is inserted into the void system. The connecting pins are inserted into the void system to secure the portion of the anchor mesh panel to the face panels. The earthen wall is accessible through the openings in the wall face.

7 Claims, 5 Drawing Sheets

MECHANICALLY STABILIZED EARTH WALL SYSTEMS AND METHODS

RELATED APPLICATIONS

This application is a continuation of Ser. No. 10/213,739, filed Aug. 6, 2002, now U.S. Pat. No. 6,685,400, which claims priority of U.S. Provisional Patent Application Ser. No. 60/310,559, was filed on Aug. 6, 2001.

TECHNICAL FIELD

The present invention relates to stabilized earthen walls and, more specifically, to a stabilized earthen wall having face panels that define gaps in which plant material may grow.

BACKGROUND OF THE INVENTION

Construction projects often require the formation of vertical or nearly vertical earthen walls. For example, the side of a hill may be excavated to obtain a suitable road grade, leaving a substantially vertical wall face on the uphill side of the road. Depending upon the composition of the earth at the wall face, the earth may require stabilization to prevent degradation or collapse of the wall face.

Earthen walls are stabilized using numerous methods. In some situations, a light coating or wire mesh may be applied to the face of the wall to prevent loose dirt and rocks from falling from the exposed wall face. In other situations, the face of the earthen wall may be stabilized by constructing a substantially freestanding wall and backfilling the earth against the freestanding wall. Such freestanding walls are commonly made of materials such as wood or concrete. Wood or concrete may be in the form of blocks or piles that are assembled on site; a freestanding concrete wall may also be cast in place.

In many situations, the earthen wall may require stabilization beyond what can be obtained by a coating, wire mesh, or a freestanding wall. In these cases, the reinforcing wall may be mechanically connected to the earthen wall. This type of reinforcing wall will be referred to herein as a mechanically stabilized earthen wall.

A mechanically stabilized earthen wall typically comprises a substantially vertical face wall and one or more substantially horizontal anchor members connected to the face wall and buried within the earthen wall. The face wall protects the face of the earthen wall, while the anchor members reinforce the face wall.

The present invention relates to mechanically stabilized earthen walls that may be decorated with plant material to improve the aesthetic value of the earthen wall.

SUMMARY OF THE INVENTION

The present invention is a retaining wall system for stabilizing an earthen wall or a method for forming such a retaining wall system. The wall system comprises a plurality of face panels, a plurality of anchor mesh panels, and a plurality of connecting pins. The face panels each comprise first and second connecting portions. Each connecting portion comprises an upper surface and a bottom surface and defines a void system comprising a mesh opening and a locking passageway in communication with the mesh opening. The face panels further comprise a wall portion extending between the first and second connecting portions. The wall portion defines a face surface and a retaining surface. The face panels are stacked in a plurality of vertically spaced rows with the bottom surfaces of the connecting portions of a first vertically spaced row resting on the upper surfaces of the connecting portions of a second vertically spaced row. The first vertically spaced row is arranged above the second vertically spaced row. A wall face is defined by the face surfaces of the wall portions and openings formed between vertically spaced wall portions and between horizontally spaced connecting portions. A portion of the anchor mesh panels is inserted into the mesh openings. The connecting pins are inserted into the locking passageway and the mesh opening to secure the portion of the anchor mesh panel to the face panels. The earthen wall is accessible through the openings in the wall face.

DETAILED DESCRIPTION OF THE INVENTION

Figure 1:
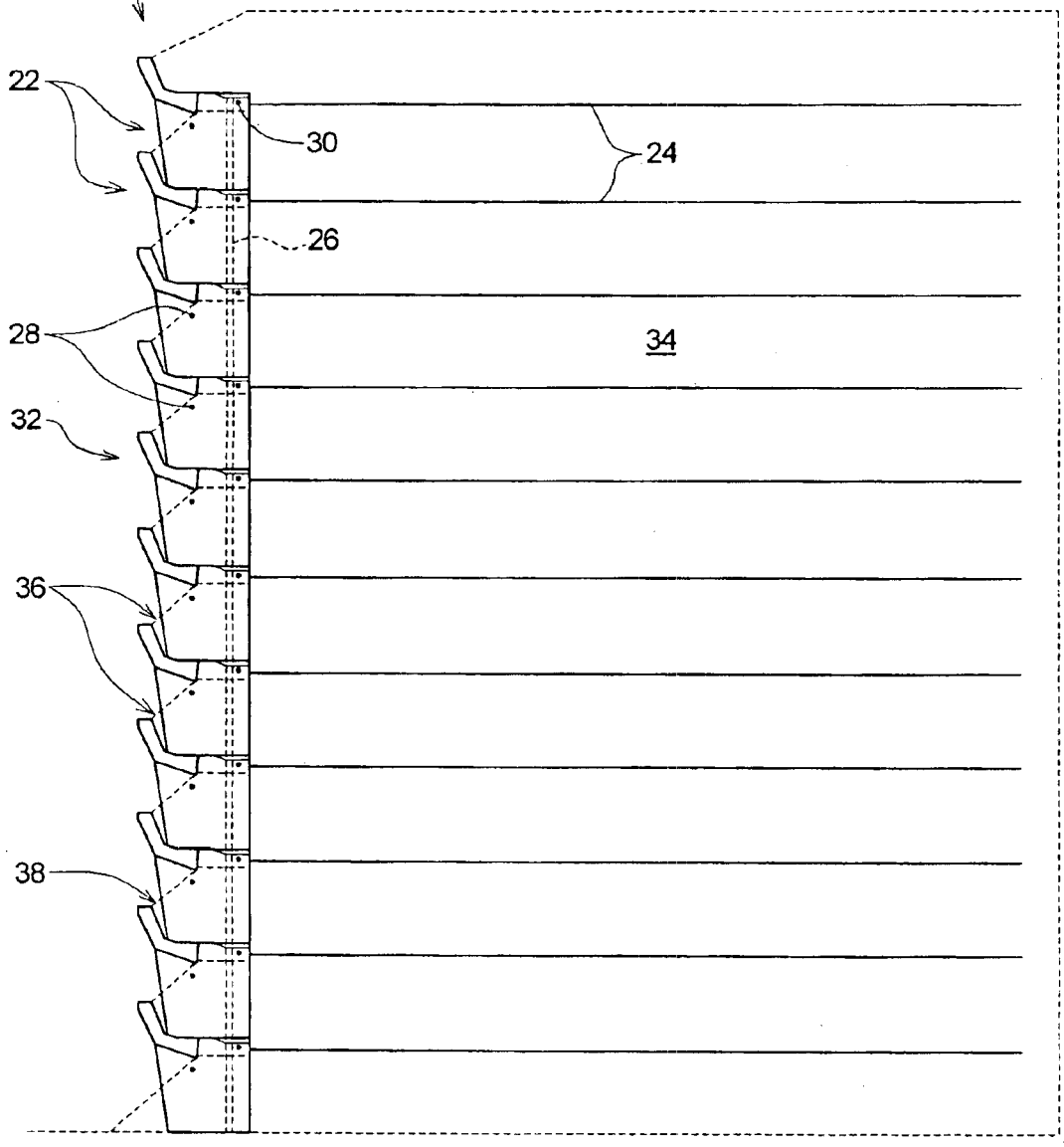
FIG. 1 is a side elevation view of a retaining wall system constructed in accordance with, and embodying, the principles of the present invention.

Referring initially to FIG. 1 of the drawing, depicted therein is a retaining wall system 20 comprising face panels 22, anchor mesh 24, vertical pins 26, horizontal pins 28, and locking pins 30. The face panels 22 are stacked in horizontal columns and vertical rows to define a wall face 32. The wall system 20 is particularly designed to form a reinforced earthen wall by retaining earthen material 34.

The vertical pins 26 hold together face panels in the vertical columns, while the horizontal pins 28 hold together adjacent face panels in horizontal rows. The locking pins attach the anchor mesh sheets 24 to the face panels 22 with the mesh 24 extending into the fill material 34.

So assembled, the face panels define gaps or openings 36. A portion of the fill material 34, as indicated at 38 in FIG. 1, is exposed through these gaps 36. Plant material thus may grow in these gaps 36 to cover or otherwise decorate the wall system 20.

Figure 3:
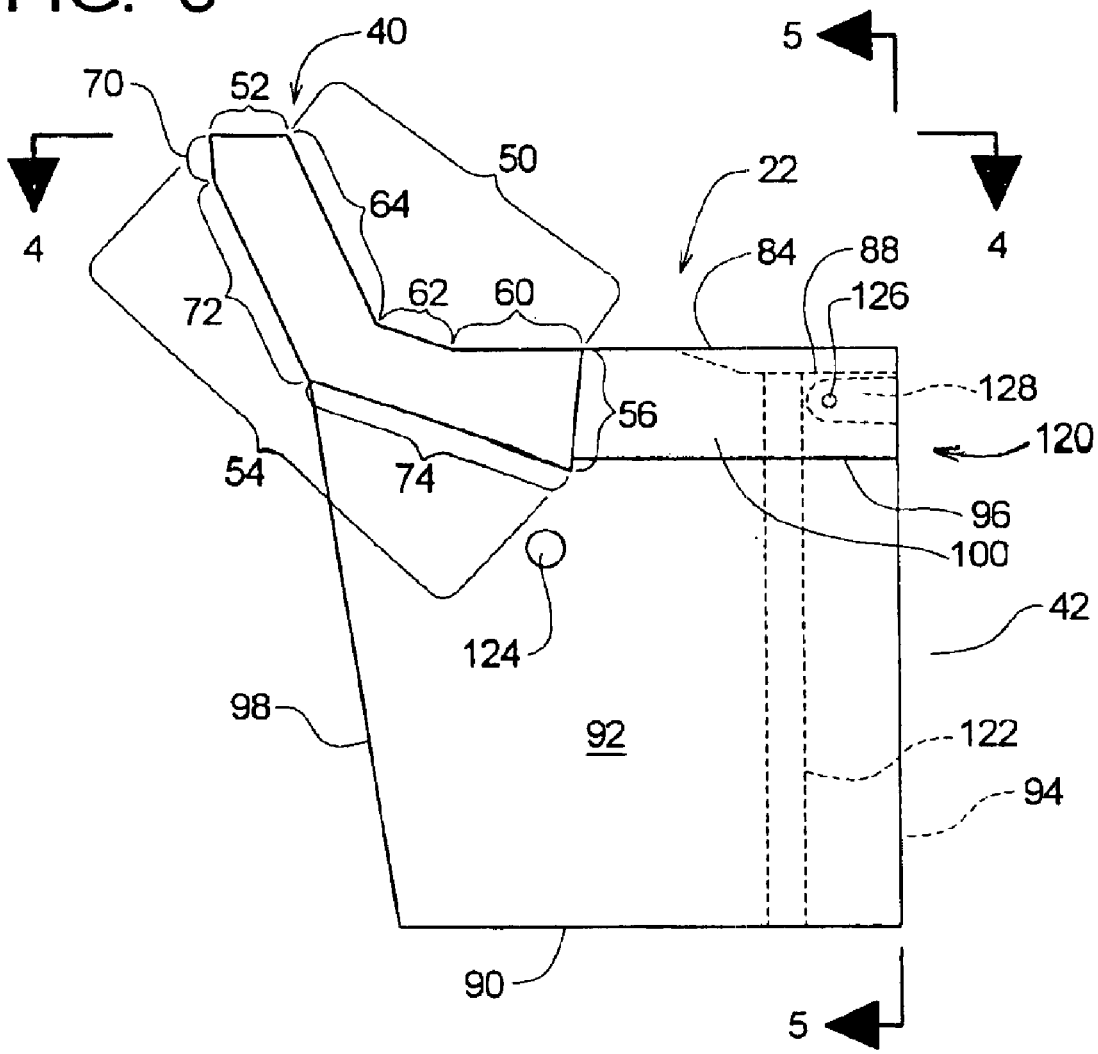
FIG. 3 is a side elevation view of a face panel used by the retaining wall system of FIG. 1.
Figure 4:
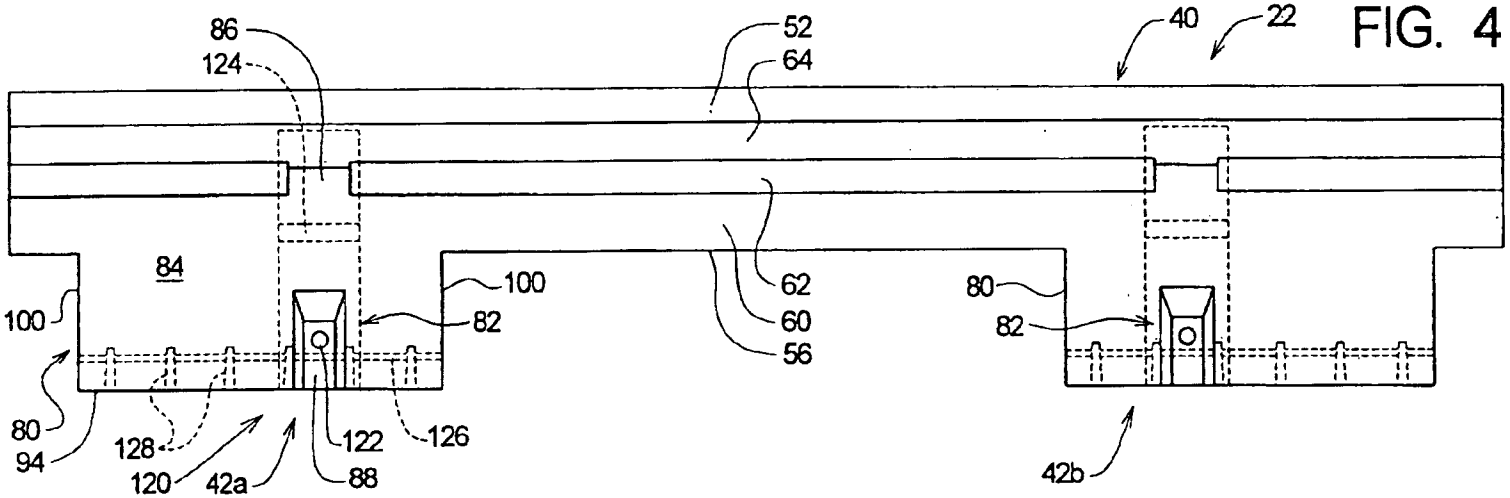
FIG. 4 is a top plan view of a face panel used by the retaining wall system of FIG. 1 taken along lines 4—4 in FIG. 3.
Figure 5:
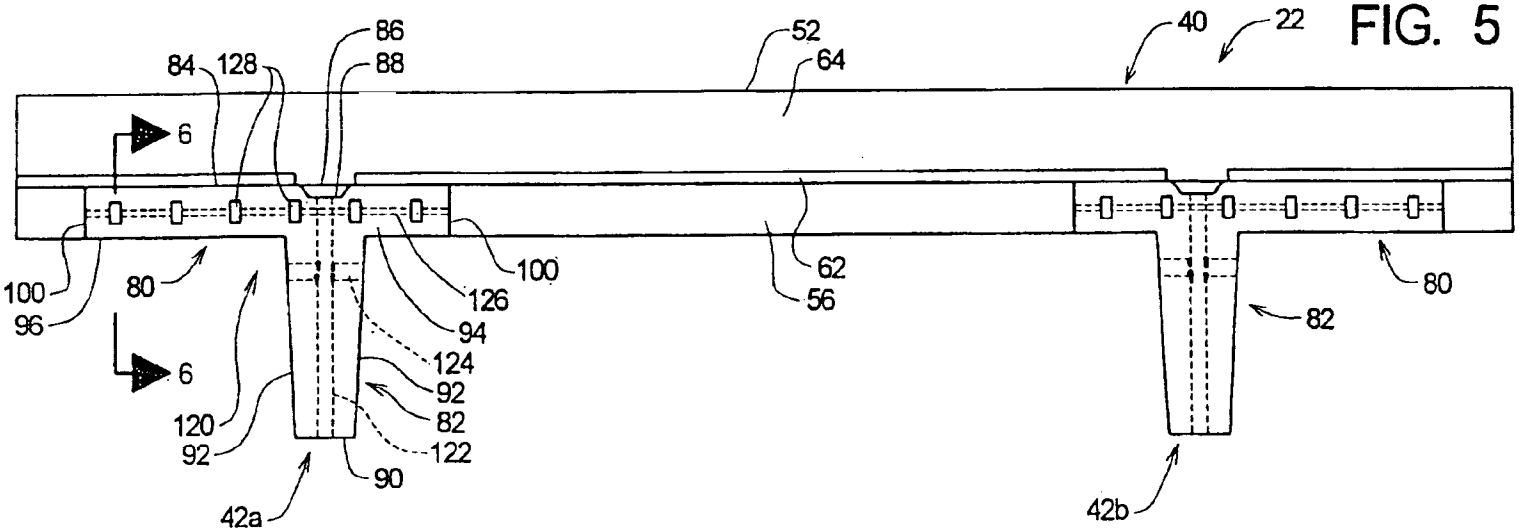
FIG. 5 is a rear elevation view of a face panel used by the retaining wall system of FIG. 1 taken along lines 5—5 in FIG. 3.

Referring now to FIG. 3, the face panels 22 will now be described in further detail. These panels 22 comprise a wall portion 40 and first and second connecting portions 42*a* and 42*b* (FIGS. 4 and 5). The first and second connecting portions 42*a* and 42*b* are identical, other than being mirror images of each other, and only the connecting portion 42*a* will be described herein with the understanding that this discussion applies to the connecting portion 42*b*.

Referring now to FIG. 3, it can be seen that the wall portion comprises a retaining surface 50, a top surface 52, a face surface 54, and a rear surface 56. The exemplary top and rear surfaces 52 and 56 are substantially flat, with the top surface being substantially horizontal and the rear surface being almost vertical. The exemplary retaining surface 50 comprises a ledge portion 60, a first riser portion 62, and a second riser portion 64. The exemplary face surface 54 comprises a front portion 70, a first return portion 72, and a second return portion 74.

FIGS. 4 and 5 show that the connecting portion 42 comprises a lateral portion 80 and a spacing portion 82. The exemplary connecting portion 42 further comprises an upper surface 84 and a notch surface 86 formed in the upper surface 84. A recess surface 88 is also formed in the upper surface 84 immediately behind the notch surface 86. The connecting portion 42 further defines a bottom surface 90 and first and second spacing surfaces 92 extending from the upper surface 84 to the bottom surface 90. A back surface 94 extends along the lateral and spacing portions 80 and 82 of the connecting portion 42. A lower surface 96 is formed on the connecting portion 42 below the lateral portion 80. A front surface 98 is formed immediately below the first returned portion 72 of the face surface 54.

Figure 6:
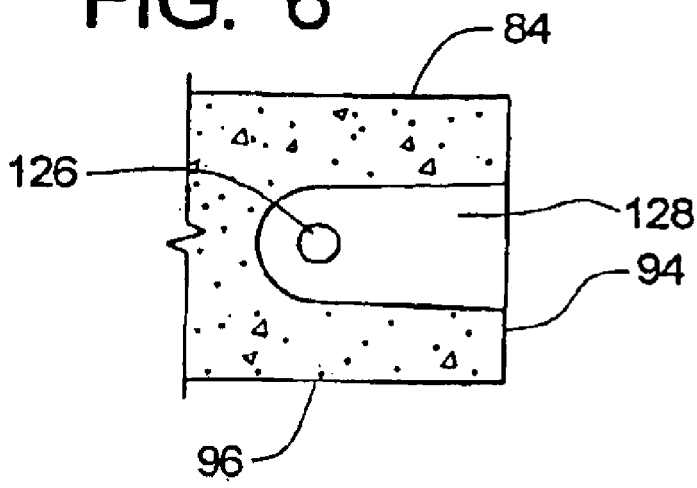
FIG. 6 is a section view taken along lines 6—6 in FIG. 5.

FIGS. 3—5 further show that the exemplary face panel 22 further comprises a void system 120 comprising a vertical passageway 122, a horizontal passageway 124, a locking passageway 126, and mesh openings 128. The vertical passageway 122 extends from the recess surface 88 to the lower surface 96. The horizontal passageway 124 extends between the spacing surfaces 92. The locking passageway 126 extends between the side surfaces 100. The mesh openings 128 extend partially into the lateral portion 80 from the back surface 94. As perhaps best shown in FIG. 6, the locking passageway 126 extends through the mesh openings 128.

Figure 2:
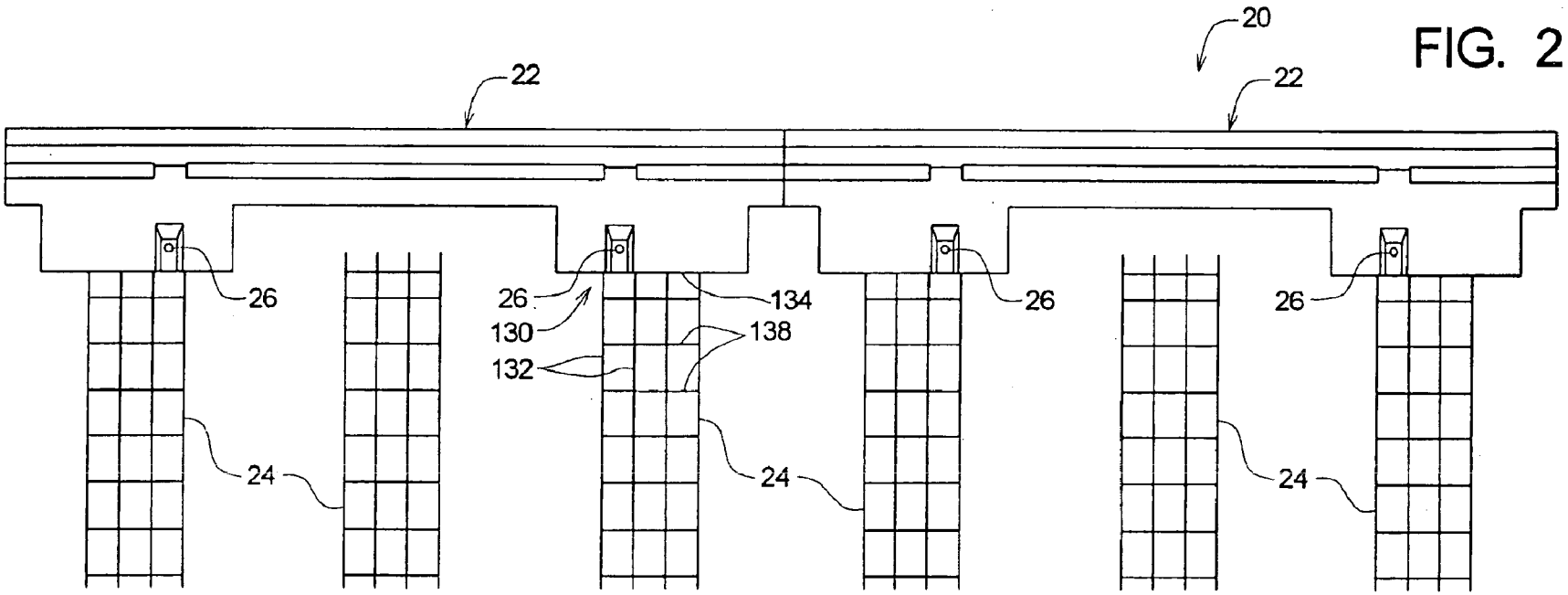
FIG. 2 is a somewhat schematic top plan view depicting retaining wall system of FIG. 1.
Figure 7:
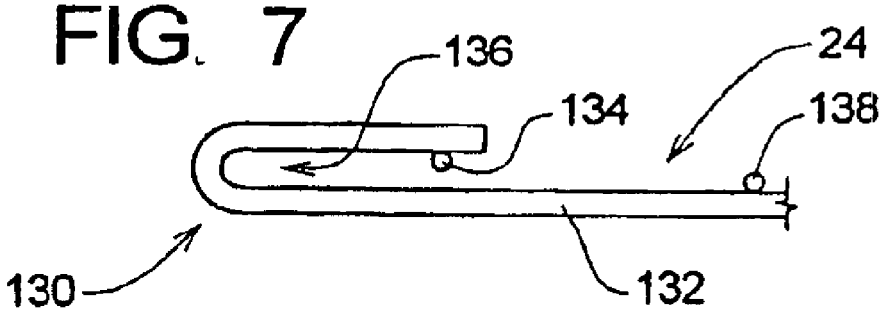
FIG. 7 is a partial side elevation view of an anchor member used with the wall system of FIG. 1.
Figure 8:
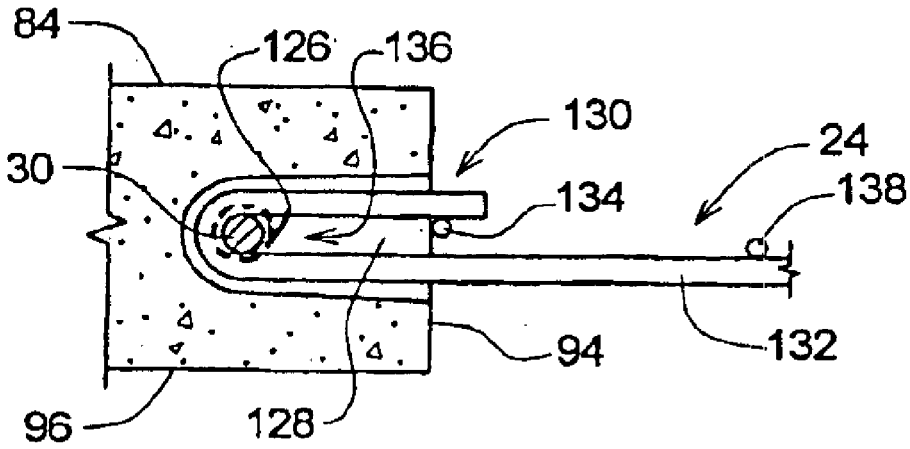
FIG. 8 is a side elevation view similar to the view of FIG. 6 illustrating the interconnection of the face panels and the anchor members.

Referring now to FIG. 7, it can be seen that the anchor mesh 124 defines a loop portion 130. In particular, the mesh comprises a plurality of tension rods 132 and lateral rods 134. The tension rods 132 extend from the face panels 122 back into the fill material 34. The tension rods 132 are bent to define the loop portions 130. One of the lateral rods 134, which will be referred to herein as the bracing rod 138, is arranged behind a closed end 136 defined by the loop portion 130. Referring now to FIG. 8, it can be seen that the loop portion 130 is inserted into the mesh openings 128 until the closed end 136 extends beyond the locking passageway 126. The locking pin 30 is then inserted through the locking passageway 126 such that the locking pin 30 prevents the anchor mesh 24 from being withdrawn from the mesh opening 128. The bracing rod 138 engages the back surface 94 of the connecting portion 42. The bracing rod 138 prevents the tension rods 132 from straightening and thus possibly disengaging from the face panel 22. so The retaining wall system 20 is thus assembled as follows. Initially, a first, lowermost, row or course of face panels 22 is laid. Horizontal pins 28 are inserted through the horizontal passageways 124 of adjacent panels 22. A small amount of fill material 34 is back filled against the first row of face panels such that a portion of the fill material thereof extends below the face surface 54 of the panels 22 of the lowermost course or row. A lowermost layer of anchor mesh 24 is then arranged on the portion of the fill material. As shown in FIG. 2, every other sheet of anchor mesh 24 is inserted into a corresponding set of mesh openings 128 in the panels 22. The locking pins 30 are then inserted through the locking passageways 126 such that every other sheet of anchor mesh 24 is connected to a connecting portion 42, with each face panel 22 connected to two sheets of anchor mesh 24.

A next row or course of face panels 22 is laid on the first row or course such that the lower surface 96 of the uppermost face panel 22 rests on the notch surface 86 and above the recess surface 88 with the vertical passageways aligned. A vertical pin 26 is then inserted into every other vertical passageway 122 to connect each face panel 22 in the upper row or course with the face panel 22 immediately therebelow. More fill material 34 is back filled against the second row or course and anchor mesh 24 attached to the face panels 22 of the second course as described above.

Another row or course of face panels 22 is then arranged on the second row or course of face panels 22. Vertical pins 26 are then inserted through the vertical passageways 122 that are offset from the passageways 122 holding the pins 26 connecting the courses immediately below. This process is repeated until the wall system 20 is at a desired or maximum allowable height.

The vertical passageway 122 is grouted such that the vertical pins 26 attach each face panel 22 to the face panel above and/or below, while the horizontal pins 28 attach the face panels to the face panels on either side. The locking pins 30 further securely fasten the anchor mesh 24 to the face panels 22 such that loads exerted on the retaining wall system 20 by the fill material 34 pull the bracing rods 138 firmly against the back surfaces 94 as described above. The anchor mesh 24 thus reinforces the wall system 20 against the loads applied by the fill material 34.

In addition, as the film material is back filled against the wall system 20, the film material will press into the gaps 36 below the wall portions 40 to form horizontal rows of dirt that allow plants to be planted along the face 32 of the wall 20.

We claim:

1. A retaining wall system for stabilizing a wall comprising:

a plurality of face panels each comprising first and second connecting portions, where each portion comprises an upper surface and a bottom surface, and defines a void system comprising a mesh opening and a locking passageway in communication with the mesh opening, a wall portion extending between the first and second connecting portions, where the wall portion defines a face surface and a retaining surface and is integrally formed with the first and second connecting portions;

a plurality of anchor mesh panels, where each anchor mesh panel comprises at least one tension rod bent to define a loop portion; and a plurality of connecting pins; whereby the face panels are stacked in a plurality of vertically spaced rows with the bottom surfaces of the connecting portions of a first vertically spaced row resting on the upper surfaces of the connecting portions of a second vertically spaced row, where the first vertically spaced row is arranged above the second vertically spaced row;

a wall face is defined by the face surfaces of the wall portions, and openings formed between vertically spaced wall portions and between horizontally spaced connecting portions;

the loop portions of the anchor mesh panels are inserted into the mesh openings;

the connecting pins are inserted into the locking passageway and the mesh opening to engage the loop portion of one of the anchor mesh panels and thereby secure the anchor mesh panel relative to the face panels; and the earthen wall is accessible through the openings in the wall face.

2. A retaining wall system as recited in claim 1, in which:

each connecting portion comprises a spacing portion and defines first and second passageways;

at least one notch surface is formed in each upper surface; and the spacing portions engage the notch surfaces to align the first and second passageways of adjacent face panels.

3. A retaining wall system as recited in claim 1, in which:

the bottoms of the openings between vertically spaced wall portions are defined by retaining surfaces of the wall portions; and the tops of the openings between vertically spaced wall portions are defined by the face surfaces of the wall portions.

4. A method of stabilizing an earthen wall comprising:

providing a plurality of face panels each comprising first and second connecting portions, where each connecting portion comprises an upper surface and a bottom surface and defines a void system comprising a mesh opening and a locking passageway in communication with the mesh opening, a wall portion extending between the first and second connecting portions, where the wall portion defines a face surface and a retaining surface and is integrally formed with the first and second connecting portions;

forming a wall face by stacking the face panels in first and second vertically spaced rows with the bottom surfaces of the connecting portions of a first vertically spaced row resting on the upper surfaces of the connecting portions of a second vertically spaced row, where the first vertically spaced row is arranged above the second vertically spaced row, and the wall face is defined by the face surfaces of the wall portions, and openings formed between vertically spaced wall portions and between horizontally spaced connecting portions;

providing a plurality of anchor mesh panels each comprising a tension member;

bending the tension member to define a loop portion;

inserting the loop portions of the anchor mesh panels into the mesh openings;

inserting connecting pins into the locking passageway and the mesh opening such that the connecting pins engage the loop portions to secure the anchor mesh panels to the face panels; and accessing the earthen wall through the openings in the wall face.

5. A method as recited in claim 4, further comprising the steps of:

forming a spacing portion on each connecting portion;

forming first and second passageways in each connecting portion;

forming at least one notch surface in each upper surface; and engaging the spacing portions with the notch surfaces to align the first and second passageways of adjacent face panels.

6. A method as recited in claim 4, in which:

the bottoms of the openings between vertically spaced wall portions are defined by retaining surfaces of the wall portions; and the tops of the openings between vertically spaced wall portions are defined by the face surfaces of the wall portions.

7. A method as recited in claim 4, further comprising the step of forming the second row such that face panels in the second row are supported by the face panels of the first row such that:

the first passageways of the vertically adjacent wall panels are aligned; and the second passageways of laterally adjacent wall panels are aligned.

* * * * *